US006087911A

United States Patent [19]

Tada et al.

[11] Patent Number: 6,087,911

[45] Date of Patent: Jul. 11, 2000

[54] DIELECTRIC FILTER, DUPLEXER, AND COMMUNICATION SYSTEM

[75] Inventors: Hitoshi Tada; Hideyuki Kato, both of Ishikawa-ken, Japan

[73] Assignee: Murata Manufacturing Co., Ltd., Japan

[21] Appl. No.: 09/141,986

[22] Filed: Aug. 28, 1998

[30] Foreign Application Priority Data

Aug. 29, 1997 [JP] Japan ..... 9-233440
Jul. 9, 1998 [JP] Japan ..... 10-194388

[51] Int. Cl.[7] ..... H01P 1/205

[52] U.S. Cl. ..... 333/206; 333/134; 333/207

[58] Field of Search ..... 333/126, 129, 333/134, 202, 206

[56] References Cited

U.S. PATENT DOCUMENTS 4,464,640 8/1984 Nishikawa et al. ..... 333/202
5,602,518 2/1997 Clifford, Jr. et al. ..... 33/206 X
5,844,454 12/1998 Ono et al. ..... 333/206

*Primary Examiner*—Seungsook Ham
*Attorney, Agent, or Firm*—Ostrolenk, Faber, Gerb & Soffen, LLP

[57] ABSTRACT

The invention provides a dielectric filter, comprising: a dielectric block having a first end surface and a second end surface opposite to said first end surface; a plurality of resonator holes passing through from said first end surface to said second end surface of said dielectric block; an inner conductor provided on an inner surface of said resonator holes; and an outer conductor provided on an outside surface of said dielectric block; wherein said first end surface of said dielectric block constitutes a short-circuit end surface; said short-circuit end surface includes an inside portion including ends of said resonator holes adjacent to each other and an outside portion provided around said inside portion; said inside portion is electrically separated from said outside portion by a non-conducting portion substantially encircling said inside portion; and said inside portion is connected to said outside portion by a microinductance generating means.

According to this dielectric filter, it is possible to easily adjust the coupling between adjacent dielectric resonators without altering the configuration and dimensions of a dielectric block.

10 Claims, 12 Drawing Sheets

DIELECTRIC FILTER, DUPLEXER, AND COMMUNICATION SYSTEM

BACKGROUND OF THE INVENTION

1. Technical Field of the Invention

The present invention relates to a dielectric filter, a duplexer, and a communication system.

2. Description of the Related Art

A dielectric filter including a plurality of dielectric resonators in a single dielectric block, a dielectric filter shown in FIG. 21, for example, has been known. In this dielectric filter, two resonator holes 2*a*, 2*b* are provided through the end surfaces 1*a*, 1*b* facing each other of a dielectric block 1. Nearly all over the outside surface of the dielectric block, an outer conductor 5 is provided. A pair of input and output electrodes 6, 6 are provided on the outside surface of the dielectric block 1 in such a way that the electrodes are kept a fixed distance away from the outer conductor 5 and are not conductive to the outer conductor 5. An inner conductor 7 is provided on subatantially all of the inside surface of the resonator holes 2*a*, 2*b* and a gap 8 is provided between the inner conductor 7 and the outer conductor 5 extended into the inside surface on this side of the resonator holes 2*a*, 2*b*.

In a conventional dielectric filter, changing the distance between the axes of the resonator holes 2*a*, 2*b* adjacent to each other or changing the external dimensions of their dielectric block was required to adjust the degree of electromagnetic coupling between the resonator holes 2*a* and 2*b*. This fact has brought about the following problems. Dies of various dimensions were needed to prepare for manufacture of dielectric blocks and adjustment of the degree of electromagnetic coupling between dielectric resonators was complicated. As a result, not only there was the lack of flexibility in changing their design, but also manufacturing cost of dielectric filters became high.

SUMMERY OF THE INVENTION

Accordingly, the present invention is to provide a dielectric filter, a duplexer, and a communication system which allow easy adjusting of the electromagnetic coupling between dielectric resonators adjacent to each other without changing the exterior configuration and dimensions of a dielectric block.

The present invention provides a dielectric filter, comprising: a dielectric block having a first end surface and a second end surface opposite to said first end surface; a plurality of resonator holes passing through from said first end surface to said second end surface of said dielectric block; an inner conductor provided on an inner surface of said resonator holes; and an outer conductor provided on an outside surface of said dielectric block; wherein said first end surface of said dielectric block constitutes a short-circuit end surface; said short-circuit end surface includes an inside portion including ends of said resonator holes adjacent to each other and an outside portion provided around said inside portion; said inside portion is electrically separated from said outside portion by a non-conducting portion substantially encircling said inside portion; and said inside portion is connected to said outside portion by a microinductance generating means.

In the above dielectric filter, the non-conducting portion may be strip-shaped. And, the microinductance generating means may be, for example, a metal lead wire. Also, the expression of the non-conducting portion subatantially encircling the resonator holes implies both that the non-conducting portion encircles the ends of the resonator holes completely and that the non-conducting portion encircles the ends of the resonator holes with only a part of the conductor which remains around the ends of the resonator holes.

According to the above dielectric filter, the resonator holes adjacent to each other, which constitute dielectric resonators adjacent to each other and the ends of which are included in the inside portion of the outer conductor on the short-circuit end surface, are grounded through a microinductance generating means. That is, the dielectric resonators adjacent to each other are connected to each other by the microinductance generating means. Accordingly, by changing the inductance of the microinductance generating means, the degree of coupling between the dielectric resonators adjacent to each other can be adjusted.

In the above dielectric filter, the microinductance generating means is preferably arranged so as to be in a position keeping substantially same distance from each of the ends of the resonator holes adjacent to each other. By this structure, the microinductance generating means equally operates to each of the two dielectric resonators comprising the resonator holes adjacent to each other.

In the above described dielectric filter, at least one of the resonator holes may have a step portion. Here, when a resonator hole is composed of, for example, a large-diameter sectional portion and a small-diameter sectional portion linked to the large-diameter sectional portion, this step portion is provided in the boundary portion between the large-diameter sectional portion and the small-diameter sectional portion. Or when a resonator hole consists of at least two linked portions having different shapes in their cross section, a step portion is provided in the boundary portion in which their cross section are different from each other. By these step portions, the dielectric resonators' resonator length can be lengthened, and the coupling of dielectric resonators can also be controlled.

In the above dielectric filter, an open circuit surface of dielectrics resonator may constitute a second end surface and on the second end surface a fine frequency adjustment pattern may be extended from either of the inner conductor or the outer conductor is provided. Here, the fine frequency adjustment means, for example, fine adjustment of a center frequency and a bandwidth. The fine frequency adjustment pattern constitutes a coupling capacity between the inner conductors of the adjacent dielectric holes and a part of the capacity between each dielectric hole and an outer conductor. Therefore, by changing the configuration of the fine frequency adjustment pattern, it is possible to alter the coupling capacity between dielectric resonators adjacent to each other and the resonance frequency of dielectric resonators.

In the above described dielectric filter, the outer conductor may be extended on a second end surface of a dielectric block and a gap is provided between the extended outer conductor and an inner conductor provided on the inner wall surface of resonator holes. In this way, an open end of dielectric resonators is provided inside the resonator holes.

The present invention further provides a duplexer characterized by having at least one of the dielectric filters showing the above-mentioned characteristics. The duplexer may be composed of a dielectric filter for the transmitter system and a dielectric filter for the receiver system in a radio communication equipment. The dielectric filter for the transmitter system supplies an output signal from a transmitter circuit system in a radio communication equipment to an antenna as a transmission signal having a fixed frequency and bandwidth. On the other hand, the dielectric filter for the receiver system selects a signal having a fixed frequency out of signals supplied from an antenna and supplies the signal to the receiver circuit system. The coupling between the dielectric resonators constituting the dielectric filter for the transmitter and receiver systems is adjusted by a microinductance generating means.

The present invention further provides a communication system comprising at least one of the dielectric filters and duplexers having the above-described characteristics. It is possible to adjust the degree of coupling between dielectric resonators simply and in a wide range without altering the configuration and dimensions of their dielectric block.

Other features and advantages of the present invention will become apparent from the following description of preferred embodiments of the invention which refers to the accompanying drawings, wherein like reference numerals indicate like elements to avoid duplicative description.

PREFERRED EMBODIMENTS OF THE PRESENT INVENTION

Figure 1:
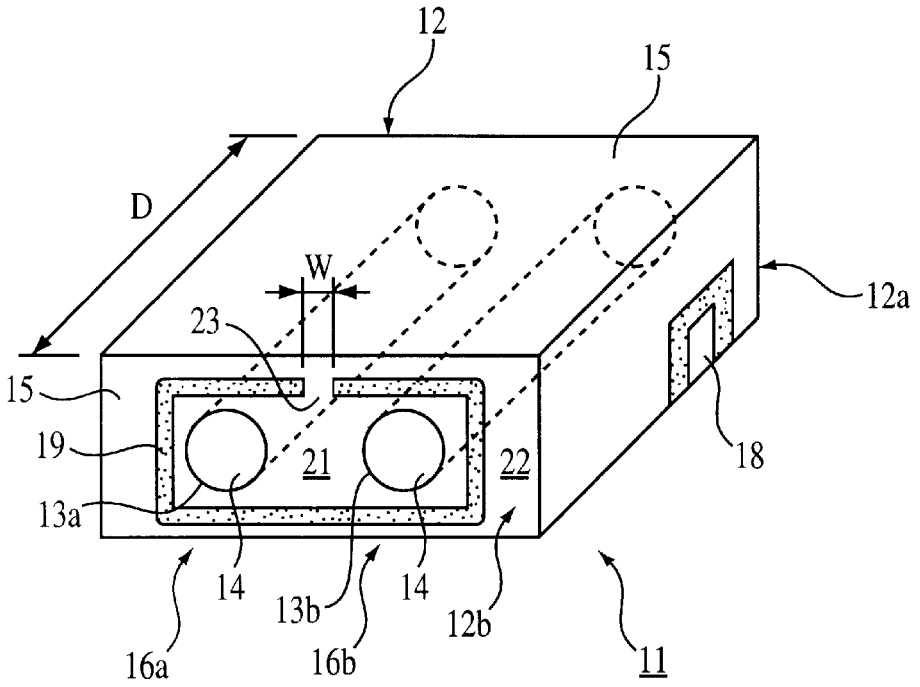
FIG. 1 is a perspective view of a first preferred embodiment of a dielectric filter relating to the present invention when it is looked at from the side of short-circuit end surface.
Figure 2:
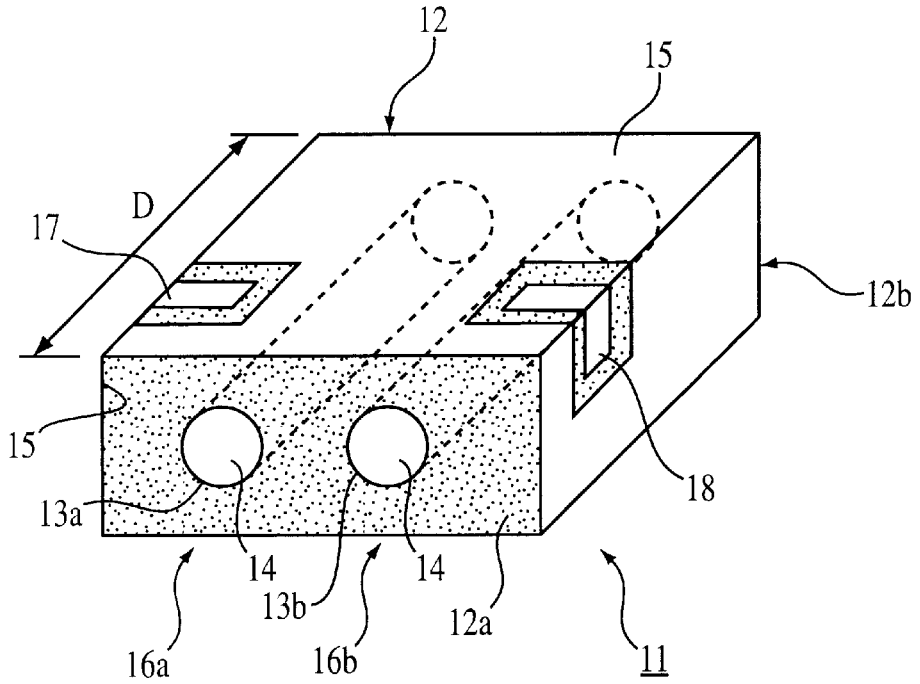
FIG. 2 is a perspective view of the dielectric filter shown in FIG. 1 when looked at from the side of open circuit surface.

First preferred embodiment, FIGS. 1 and 2

A dielectric filter 11 includes a single dielectric block 12 having the shape of a rectangular parallelepiped, and the dielectric block 12 has two resonator holes 13*a*, 13*b* passing through from one of its end surfaces 12*a*, 12*b* opposite to each other to the other. FIG. 1 is a perspective view of the dielectric filter 11 when it is looked at from the end surface 12*b*, and FIG. 2 is a perspective view of the dielectric filter 11 when it is looked at from the end surface 12*a*. These two resonator holes 13*a*, 13*b* are provided in the dielectric block 12 so that their axes are in parallel to each other. On the inner wall surfaces of the two resonator holes 13*a*, 13*b* inner conductors 14, 14 are provided respectively. On the outer wall surface of the dielectric block 12, an outer conductor 15, an input electrode 17, and an output electrode 18 are provided with the end surface 12*a* left. The inner conductors 14 of the resonator holes 13*a*, 13*b* are electrically separated from the outer conductor 15 at the end surface 12*a*, and are made electrically conductive to the outer conductor 15 on the end surface 12*b* respectively.

The resonator hole 13*a* and the inner conductor 14 provided on its inner wall surface constitute one ¼ wavelength ($\lambda/4$) dielectric resonator 16 together with the dielectric block 12 and the outer conductor 15. In the same manner, the resonator hole 13*b* and the inner conductor 14 provided on its inner wall surface constitute another ¼ wavelength ($\lambda/4$) dielectric resonator 16*b* together with the dielectric block 12 and the outer conductor 15. In the dielectric resonators 16*a*, 16*b*, an open circuit surface and an short-circuit end surface constitute the end surface 12*a* and end surface 12*b* respectively. In the dielectric block 12, the distance D between the end surface 12*a* and end surface 12*b* (the so-called length of the dielectric resonators 16*a*, 16*b*) is set to be equal to the ¼ wavelength in order that these dielectric resonators 16*a*, 16*b* function as a $\lambda/4$ resonator.

The input electrode 17 and output electrode 18 are formed at locations a little towards the end surface 12*a* of the dielectric block 12 to have a fixed distance left to the outside electrode 15 so that the input and output electrodes 17 and 18 are not conductive to the outside electrode 15. External coupling capacitors Ce are formed between the input electrode 17 and the inner conductor 14 of the dielectric resonator 16*a* and between the output electrode 18 and the inside electrode 14 of the dielectric resonator 16*b* respectively.

Regarding the outer conductor 15, the outer conductor on the end surface 12*b* (short-circuit end surface) of the dielectric block 12 is electrically separated into an inside portion 21 including the resonator holes 13*a,* 13*b* therein and an outside portion provided around the inside portion 21 by a strip-shaped non-conducting portion 19 substantially encircling the resonator holes 13*a*, 13*b*. That is, the first preferred embodiment is an example in which the ends of the resonator holes 13*a*, 13*b* are encircled by the strip-shaped non-conducting portion 19 with only a part of the outside electrode left. And the inside portion and the outside portion are electrically connected through a conductor pattern 23. The conductor pattern 23 is located in a position keeping substantially same distance from each of the two resonator holes 13*a*, 13*b*. This conductor pattern 23 is provided at the same time that the outer conductor 15 is provided.

Figure 3:
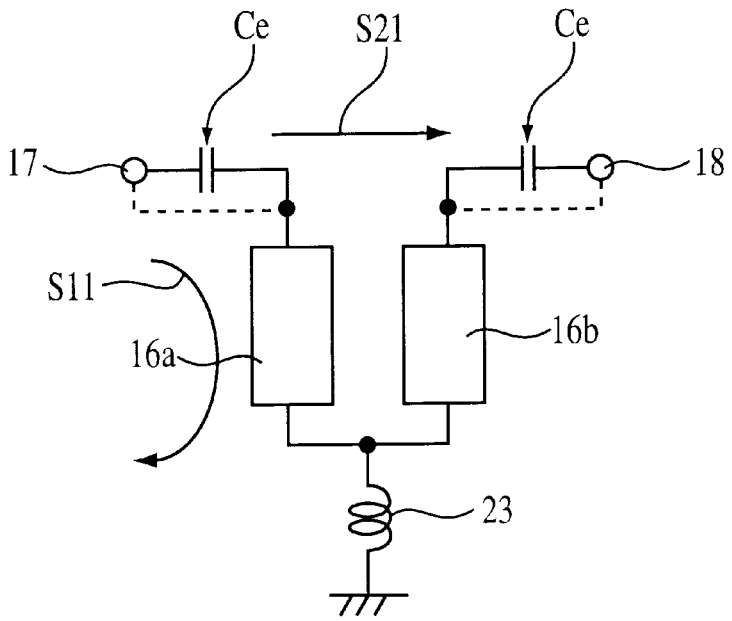
FIG. 3 is an equivalent circuit diagram of the dielectric filter shown in FIG. 1.

The dielectric filter 11 shown in FIGS. 1 and 2 has an equivalent circuit shown by a solid line in FIG. 3. That is, the short-circuit end surface side of the two dielectric resonators 16*a*, 16*b* is grounded through a microinductance which the conductor pattern 23 possesses. Also, the open circuit surface side of the dielectric resonator 16*a* is connected to the input electrode 17 through an external coupling capacitor Ce, and the open circuit surface side of the dielectric resonator 16*b* is connected to the output electrode 18 through an external coupling capacitor Ce.

The inductance of the conductor pattern 23 is determined by its thickness, configuration, and dimensions. Accordingly, the coupling between the adjacent dielectric resonators 16*a*, 16*b* can be adjusted by altering the thickness and configuration of the conductor pattern 23 or the width designated by W in FIG. 1, etc.

Table 1 shows the relationship of the inductance of the conductor pattern 23 to the degree of coupling k between the two dielectric resonators 16*a,* 16*b,* in which Dielectric constant Er of the dielectric block 12: 92

Impedance Za of the dielectric resonators 16*a*, 16*b*: 10.7 Ω

Figure 4:
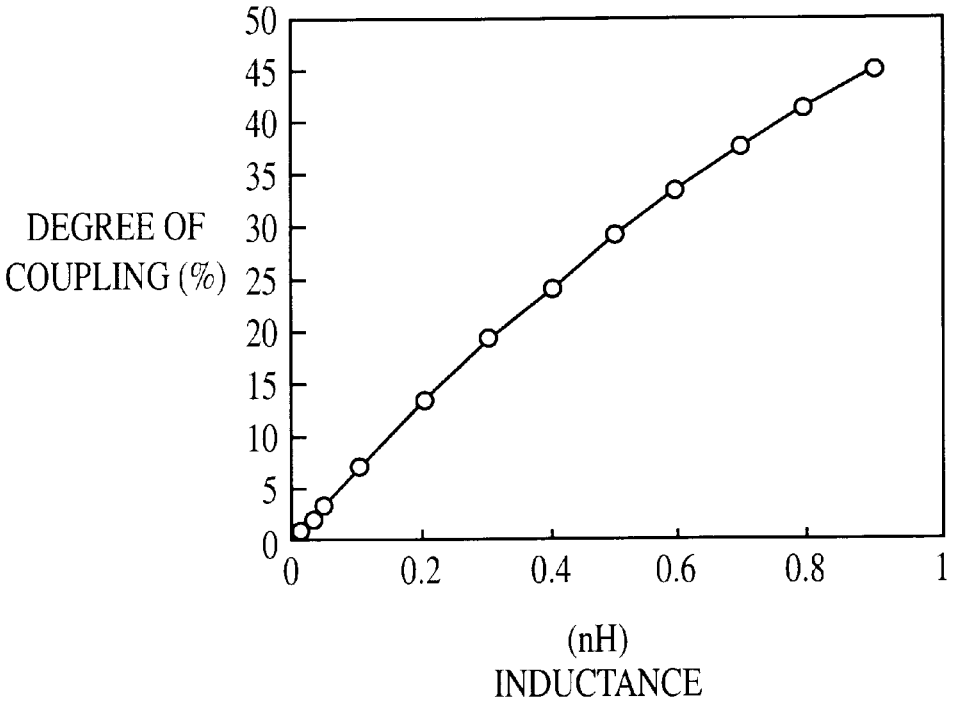
FIG. 4 is a graph showing the measurement result of the degree of coupling between the dielectric resonators of the dielectric filter shown in FIG. 1.

Length D of the dielectric resonators 16*a,* 16*b:* 8mm FIG. 4 shows Table 1 in a graphic form.

TABLE 1

| Inductance (hH) | fo (MHZ) | fe (MHZ) | fe–fo (MHZ) | k (%) |
|---|---|---|---|---|
| 0.01 | 968 | 974 | 6 | 0.6 |
| 0.03 | 954 | 974 | 20 | 2.1 |
| 0.05 | 940 | 974 | 34 | 3.6 |
| 0.1 | 908 | 974 | 66 | 7.0 |
| 0.2 | 852 | 974 | 122 | 13.4 |
| 0.3 | 804 | 974 | 170 | 19.1 |
| 0.4 | 764 | 974 | 210 | 24.2 |
| 0.5 | 724 | 974 | 250 | 29.4 |
| 0.6 | 692 | 974 | 282 | 33.9 |
| 0.7 | 664 | 974 | 310 | 37.9 |
| 0.8 | 638 | 974 | 336 | 41.7 |
| 0.9 | 616 | 974 | 358 | 45.0 |

From Table 1 and FIG. 4, it is understood that when the inductance of the conductor pattern 23 alters from 0.01 nH to 0.9 nH the degree of coupling k is increased from 0.6% to 45.0%. On the other hand, as already explained, if the thickness, configuration, or dimensions of the conductor pattern 23 are altered, the inductance changes. The thickness, configuration, or dimensions of the conductor pattern 23 can be easily changed by a simple method such as cutting the conductor pattern, etc. Therefore, the degree of coupling k between the dielectric resonators 16*a,* 16*b* can be adjusted without difficulty.

Figure 5:
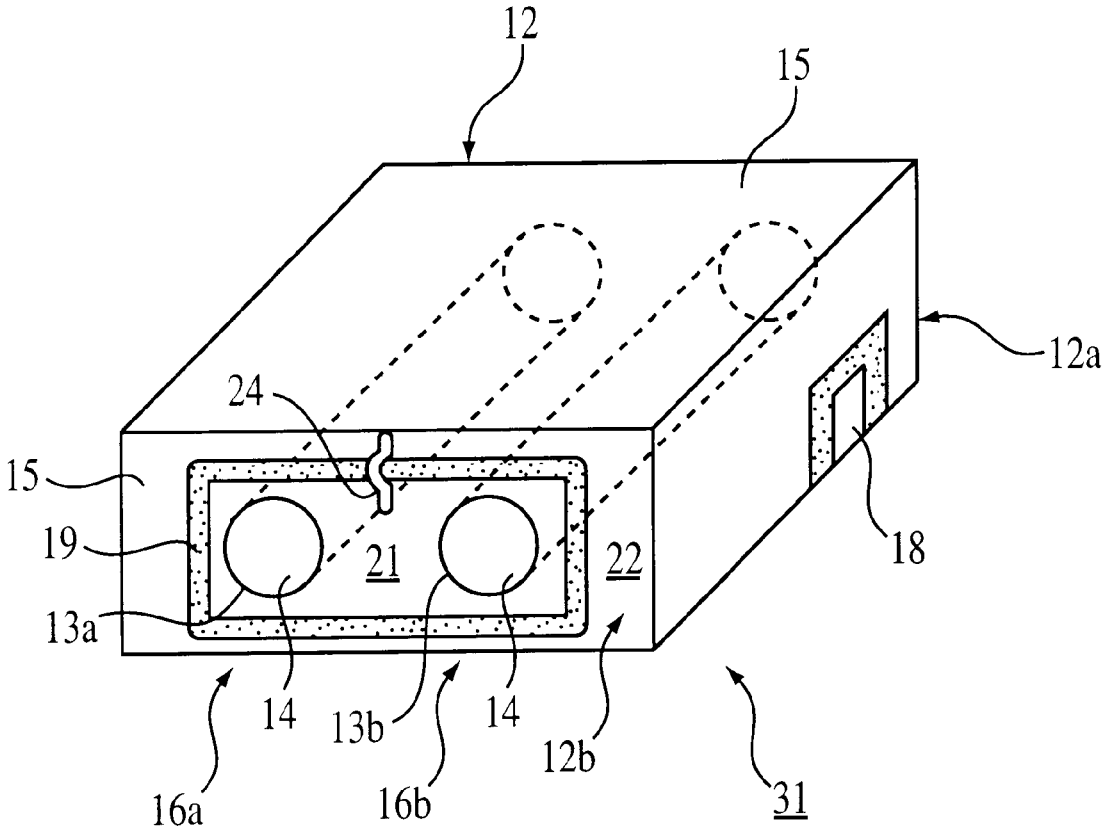
FIG. 5 is a perspective view of a second preferred embodiment of a dielectric filter relating to the present invention when looked at from the side of short-circuit end surface.

Second preferred embodiment, FIG. 5

In a dielectric filter 31, an inside portion 21 and an outside portion 22 of an outer conductor portion 15 separated on the end surface 12*b* (short-circuit end surface) of a dielectric block 12 are connected by a metal lead wire 24, different from the conductor pattern 23 in the dielectric filter 11 explained in FIGS. 1 and 2. In the outer conductor 15 on the end surface 12*b,* the inside portion 21 containing resonator holes 13*a,* 13*b* and the outside portion 22 provided around the inside portion 21 are electrically separated by a non-conducting portion 19 of a continuous rectangular shape encircling resonator holes 13*a*, 13*b*. The inductance of the metal lead wire 24 is altered by changing its cross section and length or by bending the lead wire 24. Accordingly, the degree of coupling k between dielectric resonators 16*a,* 16*b* can be easily adjusted by bending the metal lead wire 24, and so on. Further, in FIG. 5 parts corresponding to those in FIGS. 1 and 2 are designated by the corresponding numerals, and duplicate explanations are omitted.

Figure 6:
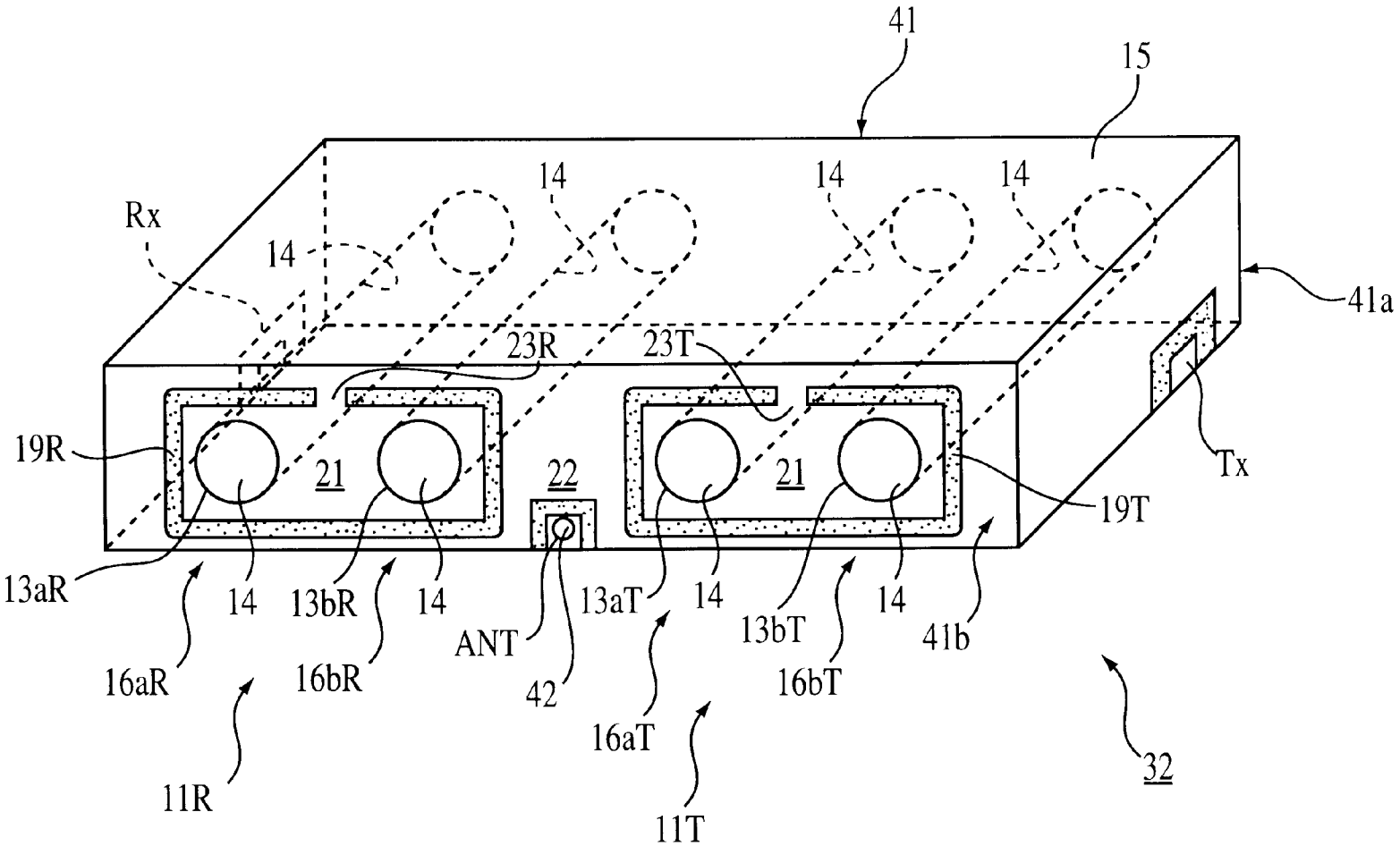
FIG. 6 is a perspective view of a third preferred embodiment of a duplexer relating to the present invention.

Third preferred embodiment, FIG. 6

A duplexer 32 is to be placed between an antenna and a transmitter circuit system and receiver circuit system of a radio communication equipment. In this duplexer, a dielectric filter 11T for the transmitter system to be placed between an antenna and a transmitter circuit system of a radio communication equipment and a dielectric filter 11R for the receiver system to be placed between an antenna and a receiver circuit system are contained in a single dielectric block 41. Each of the dielectric filter 11T for the transmitter system and the dielectric filter 11R for the receiver system has the same construction as the dielectric filter explained in FIGS. 1 and 2.

That is, the duplexer 32 has a single dielectric block 41, and the dielectric block 41 includes four resonator holes 13*a*T, 13*b*T, 13*a*R, 13*b*R which pass through from one of the end surfaces 41*a*, 41*b* opposite to each other to the other. These four resonator holes 13*a*T to 13*b*R are provided in the dielectric block 41 so that they are arranged in a line in the long side direction of the dielectric block and their axes are in parallel with each other. On the inner wall surface of each of the four resonator holes 13*a*T to 13*b*R an inner conductor 14 is provided respectively. On the wall surface of the dielectric block 41 with an end surface 41*a* on the farther side left as it is, an outer conductor 15, an electrode Tx to be connected to the transmitter circuit, an electrode Rx to the receiver circuit, and an electrode AN to the antenna are formed. The inner conductor 14 of each of the resonator holes 13*a*T to 13*b*R are electrically separated from the outer conductor 15 on the end surface 41*a,* and are made electrically conductive to the outer conductor 15 on the end surface 41*b*.

The resonator hole 13*a*T and the inner conductor 14 provided on its inner wall surface constitute one ¼ wavelength dielectric resonator 16*a*T together with the dielectric block 41 and the outer conductor 15. In the same manner, the resonator hole 13*b*T adjacent to the resonator hole 13*a*T and the inner conductor 14 provided on its inner wall surface constitute one ¼ wavelength dielectric resonator 16*b*T together with the dielectric block 41 and the outer conductor 15. These two dielectric resonators 16*a*T, 16*b*T constitute a dielectric filter 11T for the transmitter system.

The dielectric resonators 16*a*R, 16*b*R for the receiver system have quite the same construction as the dielectric resonators 16*a*T, 16*b*T in the dielectric resonator 11T for the transmitter system. These two dielectric resonators 16*a*R, 16*b*R constitute a dielectric filter 11R for the receiver system.

As for the outer conductor 15, the outer conductor on the end surface 41*b* (short-circuit end surface) of the dielectric block 41 is electrically separated into an inside portion 21 having the resonator holes 13*a*T, 13*b*T therein and an outside portion 22 provide around the inside portion 21 by a strip-shaped non-conducting portion 19T encircling in a substantially rectangular shape the resonator holes 13*a*T, 13*b*T of the dielectric resonator 11T for the transmitter system. That is, the non-conducting portion 19T in the third preferred embodiment encircles the ends of resonator holes 13*a*T, 13*b*T with only a part of the outer conductor left. And the inside portion 21 and outside portion 22 are electrically connected by a conductor pattern 23T. The conductor pattern 23T is located in a position keeping substantially same distance from each of the two resonator holes 13*a*T, 13*b*T.

Further, regarding the outer conductor 15, the outer conductor on the end surface 41*b* (short-circuit end surface) of the dielectric block 41 is electrically separated into an inside portion 21 having the resonator holes 13*a*R, 13*b*R therein and an outside portion 22 provided around the inside portion 21 by a strip-shaped non-conducting portion 19R encircling in a substantially rectangular shape the resonator holes 13*a*R, 13*b*R in the dielectric resonator 11R for the receiver system. That is, the non-conducting portion 19R in the third preferred embodiment encircles the resonator holes 13*a*R, 13*b*R with only a part of the outer conductor left. And the inside portion 21 and outside portion 22 are electrically connected by a conductor pattern 23R. The conductor pattern 23R is located in a distance substantially equal from each of the two resonator holes 13*a*R, 13*b*R.

An electrode Tx to be connected to the transmitter circuit and an electrode Rx to the receiver circuit are provided in a position towards the end surface 41*a* of the dielectric block 41 with a fixed distance to the outer conductor 15 so as to be electrically not conductive to the outer conductor 15. An external coupling capacitor Ce is provided between the electrode Tx to the transmitter circuit and the inner conductor 14 of the dielectric resonator 16*b*T and the electrode Rx to the receiver circuit and the inner conductor 14 of the dielectric resonator 16*a*R respectively. Further, an electrode ANT to be connected to antenna is provided in the central position on the end surface 41*b* of the dielectric block 41 with a fixed distance to the outer conductor 15 so as to be not conductive to the outer conductor 15. That is, the electrode ANT to antenna is provided between the dielectric filter 11R for the transmitter system and the dielectric filter 11R for the receiver system. And for the electrode ATT to be connected to antenna a hole 42 for excitation is provided, and in the inner wall of the hole 42 for excitation an inner conductor is provided. Between the dielectric resonator 16*a*T of the dielectric filter 11T for the transmitter system and the hole 42 for excitation for the electrode ATTN to antenna, and between the dielectric resonator 16*b*R of the dielectric filter 11R and the hole 42 for excitation for the electrode ATTN to antenna, there is an electromagnetic coupling respectively.

In the duplexer of the above-described construction shown in FIG. 6, the side of short-circuit end surface of the two dielectric resonators 16*a*T, 16*b*T constituting the dielectric filter 11T for the transmitter system are grounded through a microinductance which the conductor pattern 23T has. Further, the side of short-circuit end surface of the two dielectric resonators 16aR, 16bR constituting the dielectric filter 11R for the receiver system are grounded through a microinductance which the conductor pattern 23R has. Accordingly, by changing the configuration, dimensions, etc. of the dielectric resonators 16*a*T, 16*b*T constituting the dielectric filter 11T for the transmitter system can be adjusted. Also, by changing the configuration, dimensions, etc. of the other conductor pattern 23R, the degree of coupling between the dielectric resonators 16*a*R, 16*b*R constituting the dielectric filter 11R for the receiver system can be adjusted.

Figure 7:
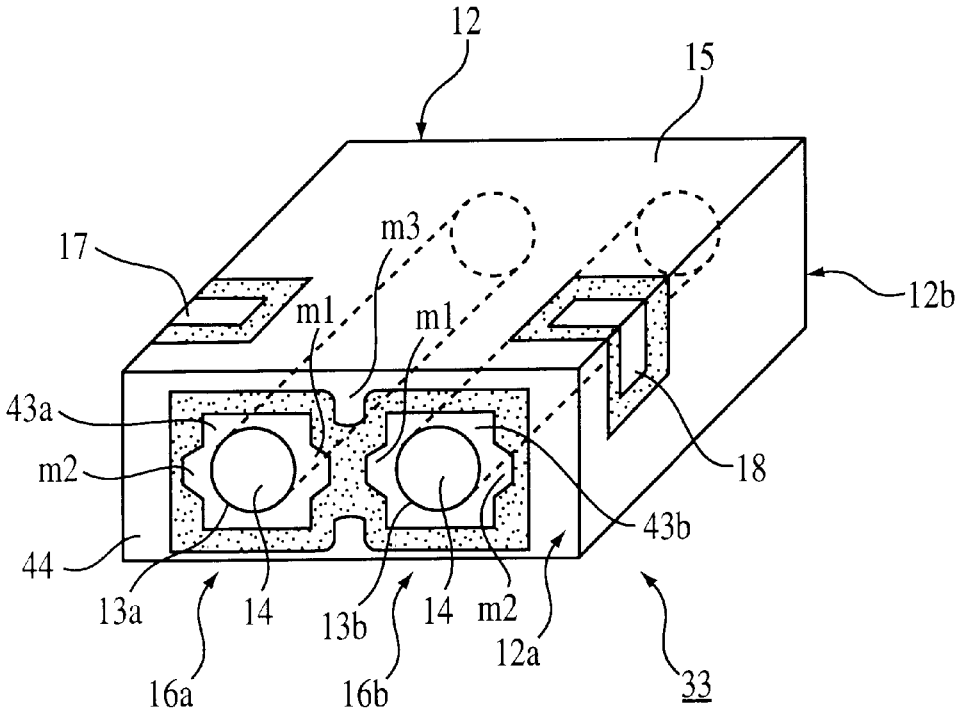
FIG. 7 is a perspective view of a fourth preferred embodiment of a dielectric filter relating to the present invention when it is looked at from the side of open circuit surface.
Figure 8:
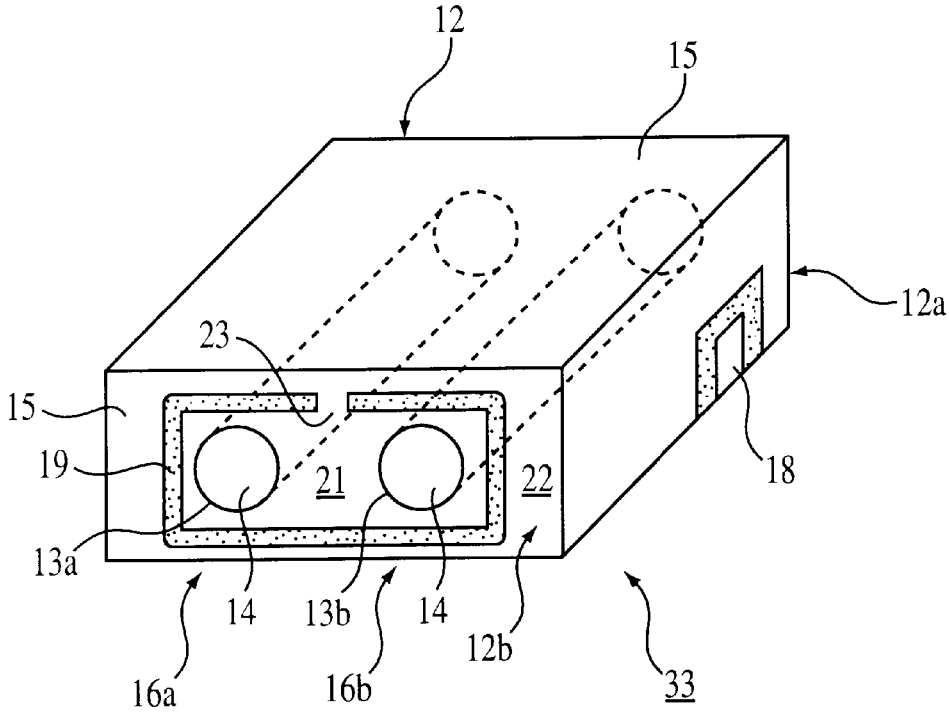
FIG. 8 is a perspective view of the dielectric filter shown in FIG. 7 when looked at from the side of short-circuit end surface.

Fourth preferred embodiment, FIGS. 7 and 8

FIG. 7 is a perspective view of a dielectric filter 33 when it is looked at from the side of the end surface 12*a* (open circuit surface 12*a*), and FIG. 8 is a perspective view of the dielectric filter 33 when it is looked at from the side of the end surface 12*b* (short-circuit end surface 12*b*). For fine adjustment of its central frequency and bandwidth, the dielectric filter 11 explained in FIGS. 1 and 2 is modified and fine-adjustment patterns 43*a*, 43*b* conductive to inner conductors 14, 14 of resonator holes 13*a*, 13*b* respectively and a fine-adjustment pattern 44 conductive to an outer conductor 15 are provided on the side of the open circuit surface 12*a* shown in FIG. 7.

As shown in FIG. 8, regarding the outer conductor 15, the outer conductor on the short-circuit end surface 12*b* of a dielectric block 12 is electrically separated into an inside portion 21 having the resonator holes 13*a*, 13*b* therein and an outside portion provided around the inside portion 21 by a strip-shaped non-conducting portion 19 encircling substantially in a rectangular shape the resonator holes 13*a*, 13*b*. And the inside portion 21 and outside portion 22 are electrically connected by a conductor pattern 23. Further, in FIGS. 7 and 8, parts corresponding to those as FIGS. 1 and 2 are designated by the corresponding numerals, and duplicate explanations are omitted.

In the dielectric filter 33 having the above construction, the degree of coupling between the two dielectric resonators 16*a*, 16*b* can be adjusted by altering the configuration, dimensions, etc. of the conductor pattern 33, but a capacitance between the fine-adjustment patterns 43*a*, 43*b* constitutes a part of the coupling capacitance between the two dielectric resonators 16*a*, 16*b*. Therefore, by altering the distance between protrusions m1 and m1 opposite to each other of the fine-adjustment patterns 43*a*, 43*b*, or by altering the extended amount of protrusions m3 of the fine-adjustment pattern 44 extended to the portion where the protrusions m1 and m1 of the fine-adjustment patterns 43*a*, 43*b* are opposite to each other, the coupling between the two dielectric resonators 16*a*, 16*b* can be adjusted in a fine manner, and the bandwidth can be adjusted. More, by altering the distance between the protrusions m2, m2 of the fine-adjustment pattern 44, the central frequency of the dielectric resonators 16*a*, 16*b* can be adjusted.

Figure 9:
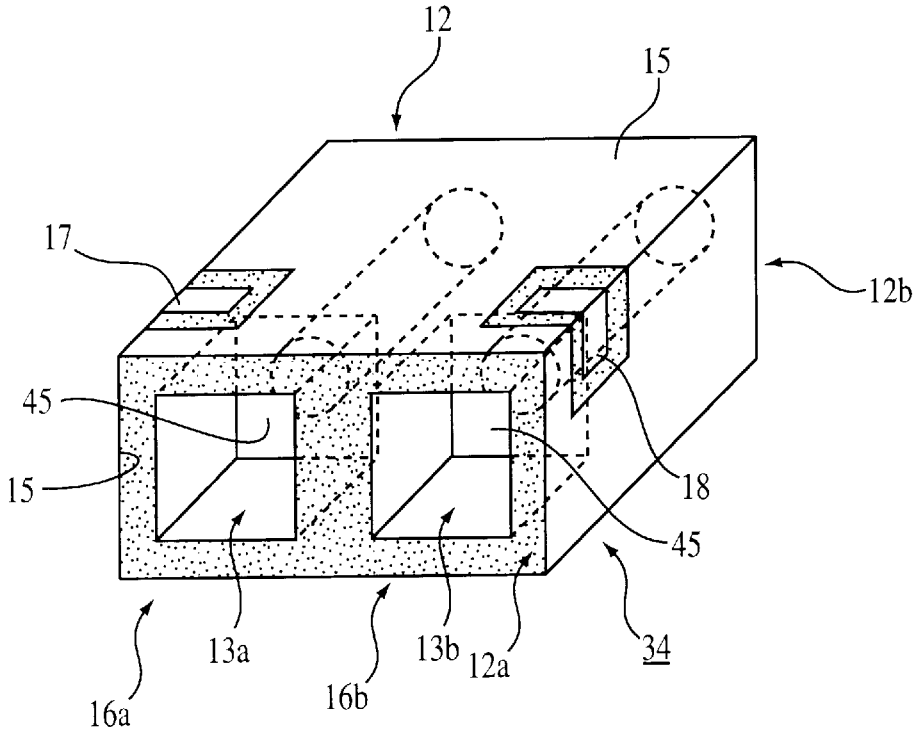
FIG. 9 is a perspective view of a fifth preferred embodiment of a dielectric filter relating to the present invention when it is looked at from the side of open circuit surface.
Figure 10:
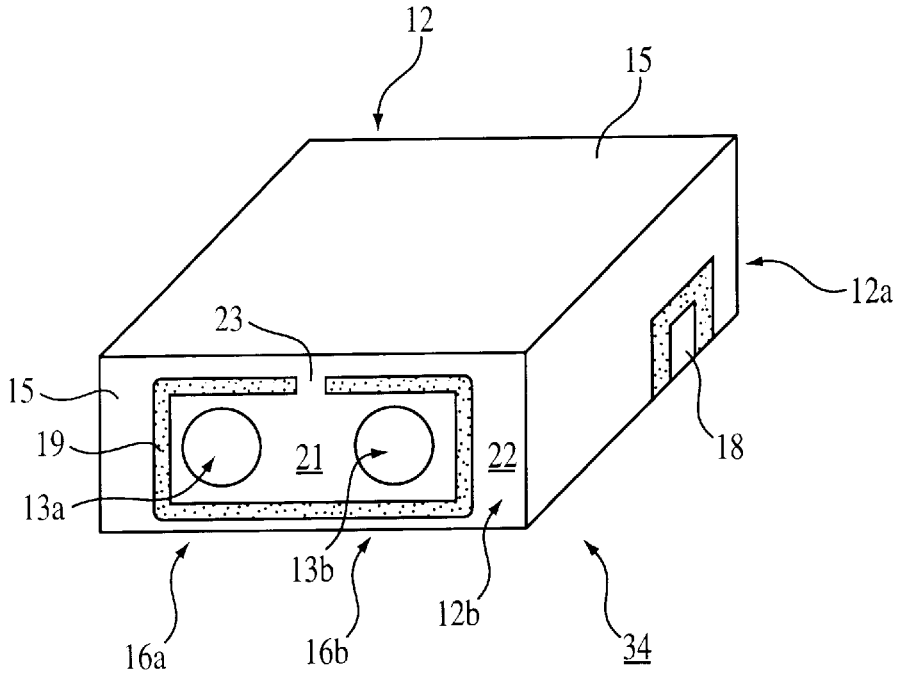
FIG. 10 is a perspective view of the dielectric filter shown in FIG. 9 when looked at from the side of short-circuit end surface.

Fifth preferred embodiment, FIGS. 9 and 10

FIG. 9 is a perspective view of a dielectric filter 34 when it is looked at from the side of the end surface 12*a* (open circuit surface 12*a*), and FIG. 10 is a perspective view of a dielectric filter 34 when it is looked at from the side of the end surface 12*b* (short-circuit end surface 12*b*). In the dielectric filter 34, the dielectric filter 11 explained in FIGS. 1 and 2 is modified and resonator holes 13*a*, 13*b* for dielectric resonators 16*a*, 16*b* are composed of the portion having a rectangular cross section provided on the side of the open circuit surface 12*a* and the portion of having a round cross section provided on the side of the short-circuit end surface 12*b* respectively.

In the boundary portion between the portion of a rectangular cross section and the portion of a round cross section, a step portion 45 is provided. The location for providing the step portion 45 is arbitrary in the direction of the axes of the resonator holes 13*a*, 13*b*. As shown in FIG. 10, regarding the outer conductor 15, the outer conductor on the short-circuit end surface 12*b* of a dielectric block 12 is electrically separated into an inside portion 21 having the resonator holes 13*a,* 13*b* therein and an outside portion provided around the inside portion 21 by a strip-shaped non-conducting portion 19 encircling the resonator holes 13*a,* 13*b* in a substantially rectangular shape. And the inside portion 21 and outside portion 22 are electrically connected by a conductor pattern 23. Further, in FIGS. 9 and 10, parts corresponding to those as FIGS. 1 and 2 are designated by the corresponding numerals, and duplicate explanations are omitted.

In the dielectric filter 34 of such a construction, the step portion 45 in the resonator holes 13*a,* 13*b* is able to not only control the degree of coupling between the neighboring dielectric resonators 16*a,* 16*b,* but also change the resonator length of the dielectric resonators 16*a,* 16*b*.

Figure 11:
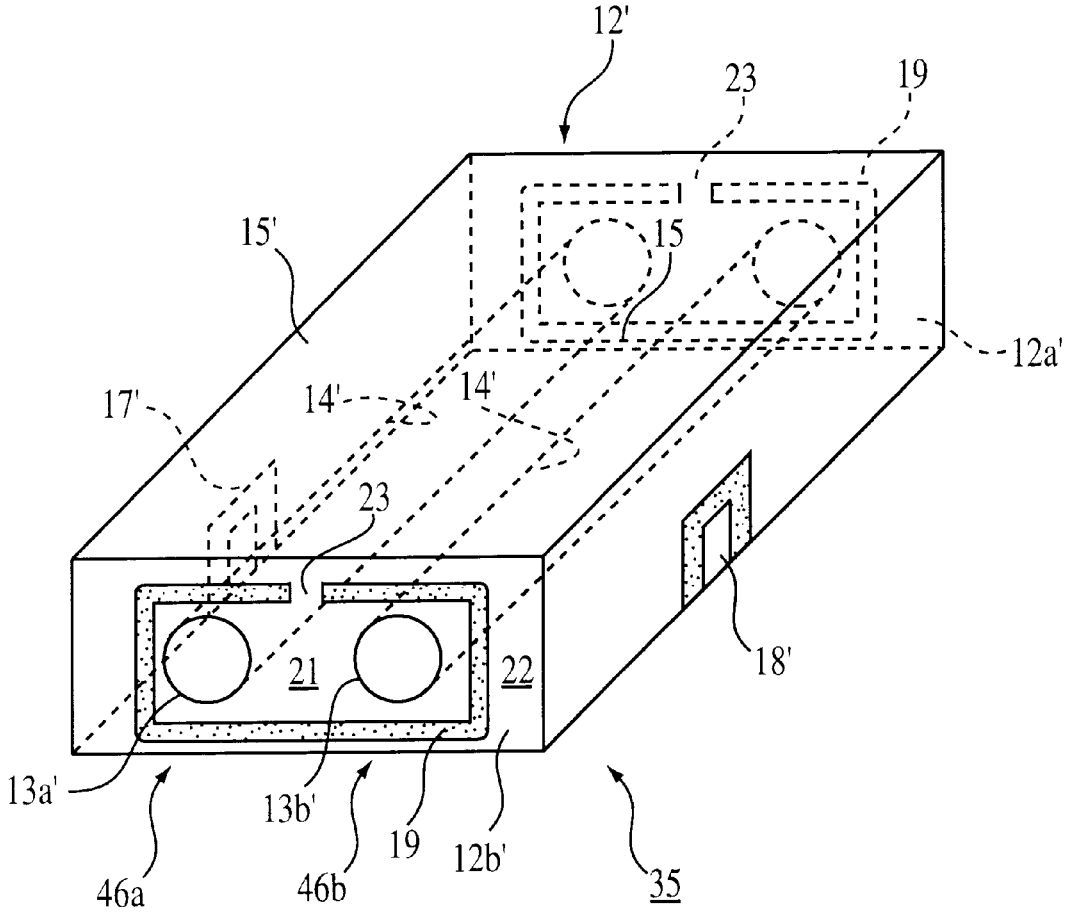
FIG. 11 is a perspective view of a sixth preferred embodiment of a dielectric filter relating to the present invention.

Sixth preferred embodiment, FIG. 11

A dielectric filter 35 is composed of two ½ wavelength dielectric resonators 46*a,* 46*b*. In a single dielectric block 12', two resonator holes 13*a'*, 13*b'* are formed. The resonator hole 13*a'* and an inner conductor 14' formed on its inner wall surface constitute a ½ wavelength (λ/2) dielectric resonator 46*a* together with the dielectric block 12' and an outer conductor 15'. In the same way, the resonator hole 13*b'* and an inner conductor 14' provided on its inner wall surface constitute another ½ wavelength (λ/2) dielectric resonator 46*b* together with the dielectric block 12' and the outer conductor 15'. In the dielectric resonators 46*a,* 46*b,* two end surfaces 12*a'*, 12*b'* of the dielectric block 12' are composed of a short-circuit end surface respectively. In the dielectric block 12', the distance between the end surfaces 12*a'* and 12*b'* (so-called length of the dielectric resonators 46*a*, 46*b*) is set to be a ½ wavelength so that these dielectric resonators 46*a*, 46*b* function as a λ/2 resonator.

An input electrode 17' and an output electrode 18' are provided in the middle on both end surfaces 12*a'* and 12*b'* of the dielectric block 12' with a fixed distance to the outer conductor 15' so as to be not conductive to the outer conductor 15'. Between the input electrode 17' and the inner conductor 14' of the dielectric resonator 46*a* and between the output electrode 18' and the inner conductor 14' of the dielectric resonator 46*b,* there are external coupling capacitors Ce formed respectively.

As for the outer conductor 15', the outer conductor on the end surface 12*b'* (short-circuit end surface) of a dielectric block 12' is electrically separated into an inside portion 21 having the resonator holes 13*a'*, 13*b'* therein and an outside portion 22 provide around the inside portion 21 by a strip-shaped non-conducting portion 19 encircling the resonator holes 13*a'*, 13*b'* in a substantially rectangular shape. That is, the sixth embodiment is an example encircling the resonator holes 13*a'*, 13*b'* with only a part of the outer conductor left as it is. And the inside portion 21 and the outside portion 22 are electrically connected through a conductor pattern 23. The conductor pattern 23 is located in a position keeping substantially same distance from each of the two resonator holes 13*a'*, 13*b'*. This conductor pattern 23 is simultaneously provided with the outer conductor 15'. Further, as for the outer conductor 15', on the end surface 12*a'* (short-circuit end surface) of the dielectric block 12', a non-conducting portion 19 is formed in the same way as described above.

In the dielectric filter 35 in FIG. 11 having the above construction, its inductance is determined by the thickness, configuration, and dimensions of the conductor pattern 23. Accordingly, by altering the thickness, configuration, thickness, etc. of the conductor pattern 23, the degree of coupling between the adjacent dielectric resonators 46*a,* 46*b* can be adjusted. Therefore, by changing the inductance of the conductor pattern 23, the coupling between the dielectric resonators 46*a,* 46*b* can be easily adjusted in a wide range without altering the configuration, dimensions, etc. of the dielectric block 12'. Further, as the substantially entire surface of the dielectric block 12' is covered by the outer conductor 15', the leak of high frequencies from the dielectric filter 35 is made small.

Figure 12:
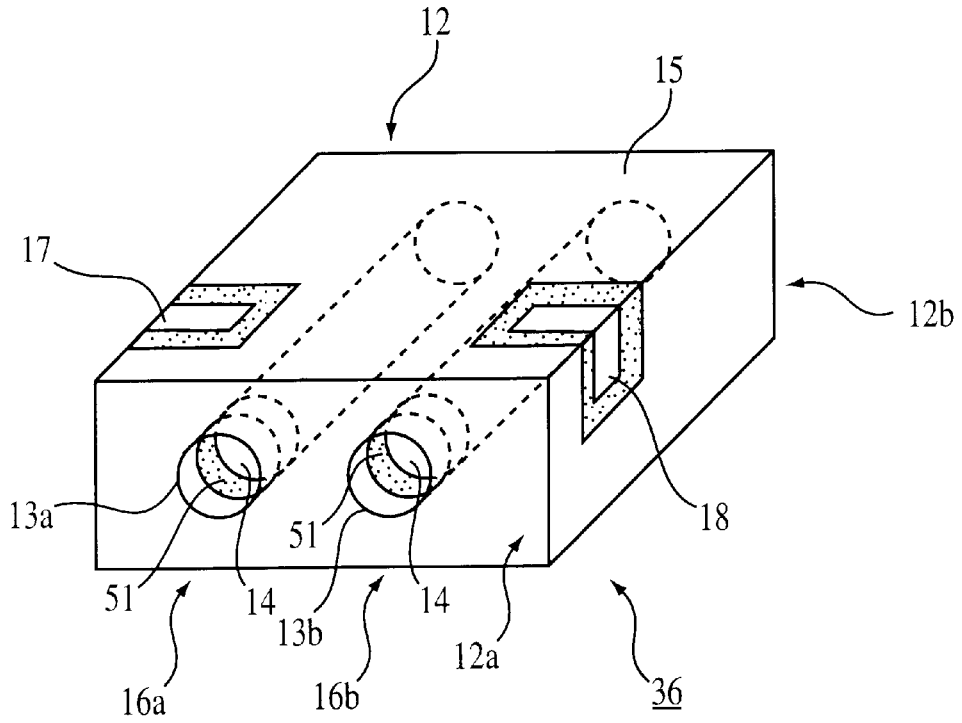
FIG. 12 is a perspective view of a seventh preferred embodiment of a dielectric filter relating to the present invention when it is looked at from the side of open circuit surface.
Figure 13:
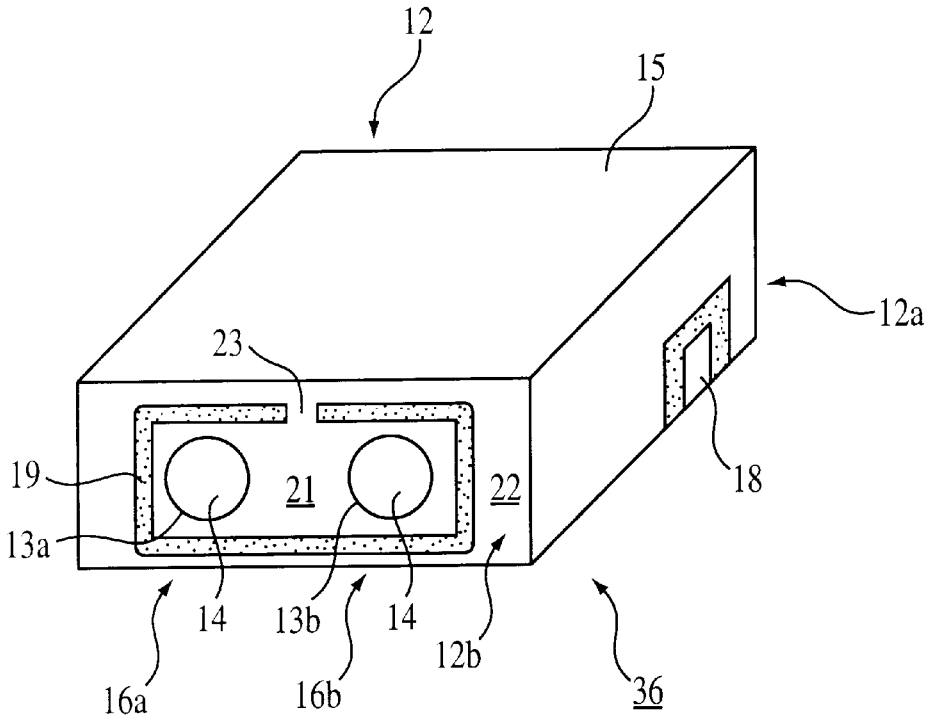
FIG. 13 is a perspective view of the dielectric filter shown in FIG. 12 when looked at from the side of short-circuit end surface.

Seventh preferred embodiment, FIGS. 12 and 13

FIG. 12 is a perspective view of a dielectric filter 36 when looked at from the side of the end surface 12*a* (open circuit surface 12*a*), and FIG. 13 is a perspective view of a dielectric filter 36 when looked at from the side of the end surface 12*b* (short-circuit end surface 12*b*). The dielectric filter 36 includes two resonator holes passing through the end surfaces 12*a,* 12*b* opposite to each other of a dielectric block 12. An outer conductor 15 is formed substantially all over the outside surface of the dielectric block 12. An input electrode 17 and an output electrode 18 are provided on the outside surface of the dielectric block 12 with a fixed distance to the outer conductor so as to be not conductive to the outer conductor 15. Inner conductors are provided on substantially all of the inner wall surface of each of the resonator holes 13*a,* 13*b*. Between the inner conductor 14 and the outer conductor 15 extended into the opening of the resonator holes 13*a,* 13*b* on the side of the end surfaces 12*a* (open circuit surface 12*a*) of the dielectric block 12, a gap is formed 51.

In the outer conductor 15, the outer conductor on the end surface 12*b* (short-circuit end surface 12*b*) of the dielectric block 12 is electrically separated into an inside portion 21 having the resonator holes 13*a,* 13*b* therein and an outside portion 22 provide around the inside portion 21 by a strip-shaped non-conducting portion encircling in a substantially rectangular shape the resonator holes 13*a,* 13*b*. And the inside portion 21 and the outside portion 22 are electrically connected through a conductor pattern 23. In the dielectric filter 36 of the above construction, the inductance is determined by the thickness, configuration, and dimensions of the conductor pattern 23. Accordingly, by altering the thickness, configuration, width, etc. of the conductor pattern 23, the coupling between the neighboring dielectric resonators 16*a,* 16*b* can be adjusted. Further, substantially all surface of the dielectric block 12 is covered by the outer conductor 15, the leak of high frequencies from the dielectric filter 36 to its surroundings becomes small. More, in FIGS. 12 and 13, parts corresponding to those in FIGS. 1 and 2 are designated by the corresponding numerals, and duplicate explanation are omitted.

Figure 14:
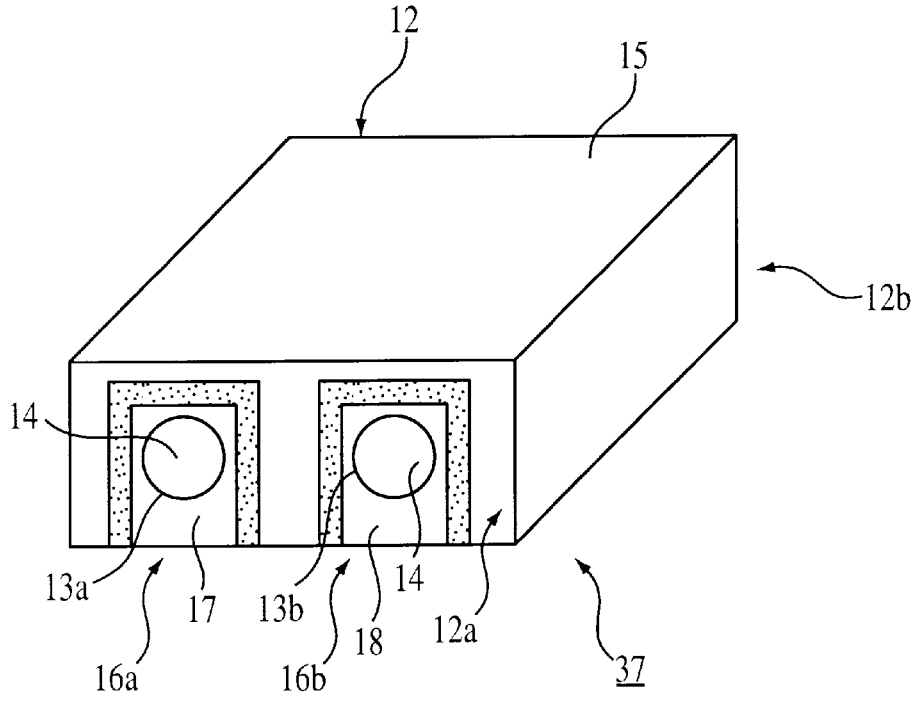
FIG. 14 is a perspective view of a eighth preferred embodiment of a dielectric filter relating to the present invention when it is looked at from the side of open circuit surface.
Figure 15:
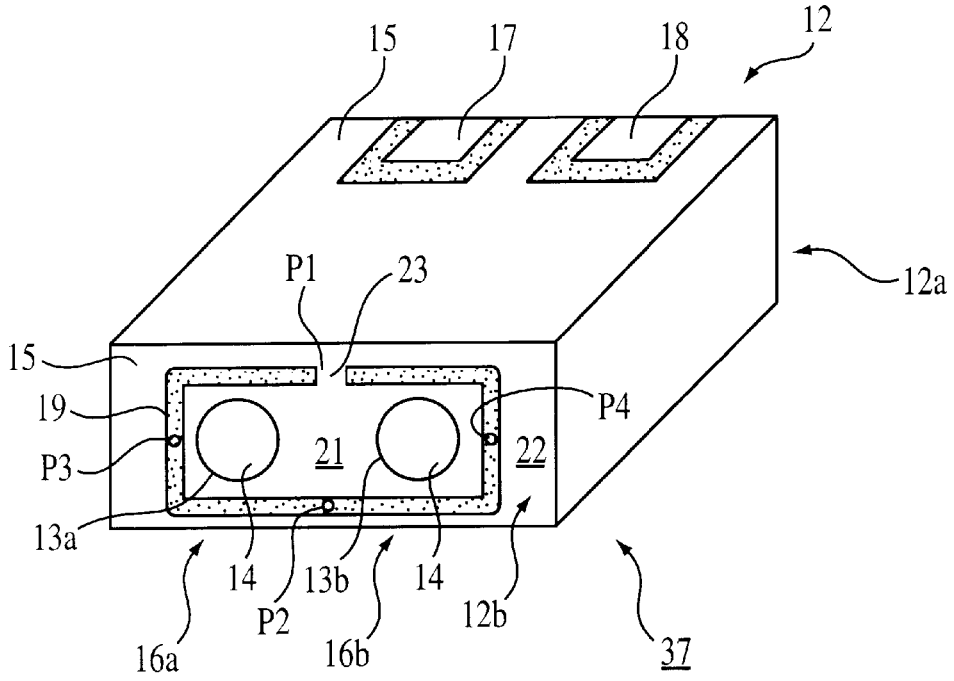
FIG. 15 is a perspective view of the dielectric filter shown in FIG. 14 when looked at from the side of short-circuit end surface.

Eighth preferred embodiment, FIGS. 14 and 15

FIG. 14 is a perspective view of a dielectric filter 37 when it is looked at from the side of the end surface 12*a* (open circuit surface 12*a*), and FIG. 15 is a perspective view of a dielectric filter 37 when it is looked at from the side of the end surface 12*b* (short-circuit end surface 12*b*). In the dielectric filter 37, the dielectric filter 11 explained in FIGS. 1 and 2 is modified and an input electrode 17 and an output electrode 18 are made to be directly connected to the inner conductors 14 on the side of open circuit surface of the dielectric resonators 16*a,* 16*b*. These input electrode 17 and output electrode 18 are provided on the outer surface of the dielectric block 12 with a fixed distance to the outer conductor 15 so as to be not conductive to the outer conductor 15.

In the outer conductor 15, the outer conductor on the end surface 12*b* (short-circuit end surface 12*b*) of the dielectric block 12 is electrically separated into an inside portion 21 having the resonator holes 13*a,* 13*b* therein and an outside portion 22 provided around the inside portion 21 by a strip-shaped non-conducting portion encircling in a substantially rectangular shape the resonator holes 13*a,* 13*b*. And the inside portion 21 and the outside portion 22 are electrically connected through a conductor pattern 23.

In the dielectric filter 37 of the above construction, as shown by a dotted line in FIG. 3 a dielectric resonator 16*a* is connected directly to the input electrode 17 and a dielectric resonator 16*b* is directly connected to the output electrode 18, and they are externally coupled in accordance with Qe ($=\pi Z_0/4Za$) given by the difference between the impedance $Z_0$ of an external circuit and the impedance Za of the dielectric resonators 16*a,* 16*b*. And by altering the configuration, dimensions, etc. of the conductor pattern 23, the degree of coupling between the two dielectric resonators 16*a,* 16*b* can be easily adjusted. Further, in FIGS. 14 and 15, parts corresponding to those in FIGS. 1 and 2 are designated by the corresponding numerals, and duplicate explanation are omitted.

Figure 16:
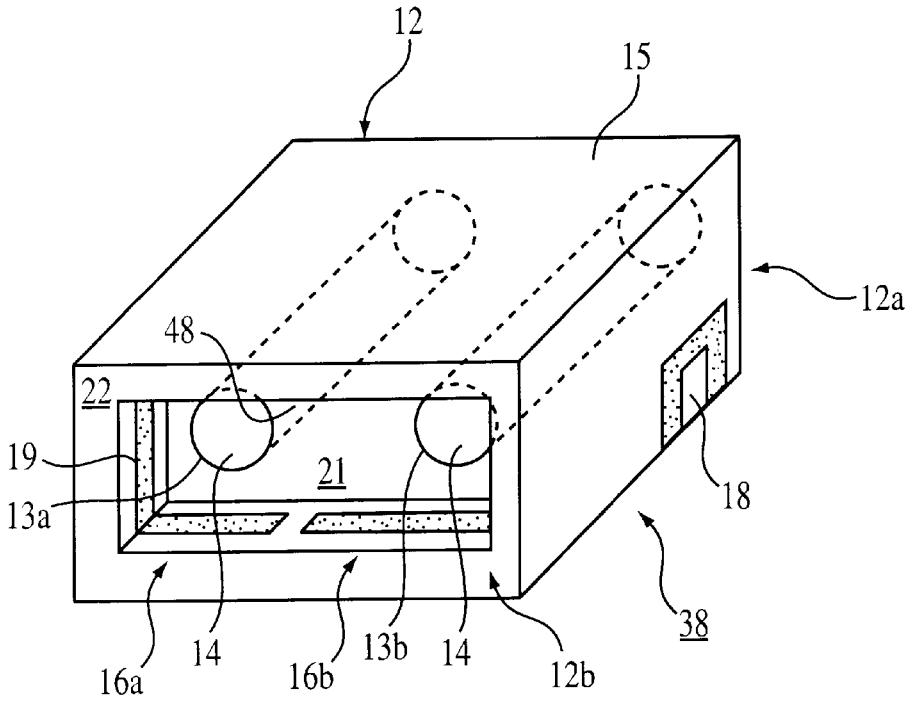
FIG. 16 is a perspective view of a ninth preferred embodiment of a dielectric filter relating to the present invention when it is looked at from the side of short-circuit end surface.

Ninth preferred embodiment, FIG. 16

FIG. 16 is a perspective view of a dielectric filter 38 when it is looked at from the side of the end surface 12*b* (short-circuit end surface 12*b*). In the dielectric filter 38, the dielectric filter 11 explained in FIGS. 1 and 2 is modified to provide a recess portion 48 in the end surface 12*b* (short-circuit end surface 12*b*) of a dielectric block 12 and to form an opening on the side of the short-circuit end surface of the resonator holes 13*a,* 13*b* in the recess portion.

As for the outer conductor 15, the outer conductor on the end surface 12*b* (short-circuit end surface 12*b*) is electrically separated into an inside portion 21 including the resonator holes 13*a,* 13*b* therein and an outside portion 22 provided around the inside portion 21 by a strip-shaped non-conducting portion 19 provided so as to substantially encircle the resonator holes 13*a,* 13*b*. And the inside portion and outside portion are electrically connected through a conductor pattern 23.

In the dielectric filter 38 having the above construction, because the short-circuit end surface of dielectric resonators 16*a,* 16*b* is located back from the end surface 12*b* of the dielectric block 12, the high frequencies generated in the dielectric filter 38 is made hard to leak. Also, the effect of high frequencies from the outer environment on the dielectric filter 38 is reduced.

Figure 17:
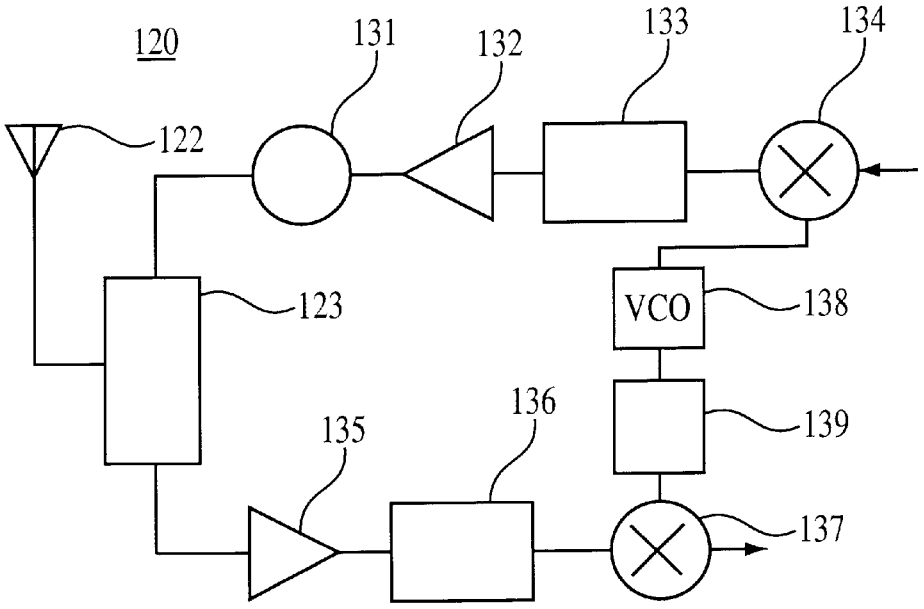
FIG. 17 is a block diagram showing a tenth preferred embodiment of the present invention relating to a communication system.

Tenth preferred embodiment, FIG. 17

The tenth preferred embodiment shows a communication system relating to the present invention, and is explained with a portable telephone taken as an example.

FIG. 17 is a block diagram showing the RF part of an electric circuit of a portable telephone 120. In FIG. 17, the numeral 122 indicates an antenna element, 123 duplexer, 131 isolator on the transmitter side, 132 amplifier on the transmitter side, 133 inter-stage band pass filter on the transmitter side, 134 mixer on the transmitter side, 135 amplifier on the receiver side, 136 inter-stage band pass filter on the receiver side, 137 mixer on the receiver side, 138 voltage-controlled oscillator (VCO), and 139 band pass filter for local use.

Here, for example, the above-described duplexer 32 of the third embodiment can be used as a duplexer 123. Also, for example, the above-mentioned dielectric filters of the first, second, fourth to ninth preferred embodiments 11, 31, 33 to 38 can be used as an inter-stage band pass filter on the transmitter side 133, and an inter-stage band pass filter on the receiver side, and a band pass filter for local use. By using these filters 11, 31, 33 to 38 and a duplexer 33, a portable telephone 120 easy to adjust the degree of electromagnetic coupling between dielectric resonators, flexible to cope with design change, and of low manufacturing cost can be realized.

Other preferred embodiments

Still more, a dielectric filter, a duplexer, and a communication system relating to the present invention are not limited to the above-described embodiments and can be variously modified within the scope of the essential points.

For example, the configuration and diameter of resonator holes in the dielectric filters and duplexers can be different from each other. That is, a plurality of resonator holes provided in one dielectric filter may have their own configuration and diameter respectively, or in a duplexer a resonator hole for the dielectric filter in the transmitter system and a resonator hole for the dielectric filter in the receiver system may be different in their configuration and diameter from each other. Further, for downsizing of dielectric filters and duplexers conductor length of the inner conductor may be lengthened by using a resonator hole composed of a large-diameter sectional portion and a small-diameter sectional portion linked to the large-diameter sectional portion and a step portion provided at the boundary between the large-diameter sectional portion and small-diameter sectional portion.

Figure 18:
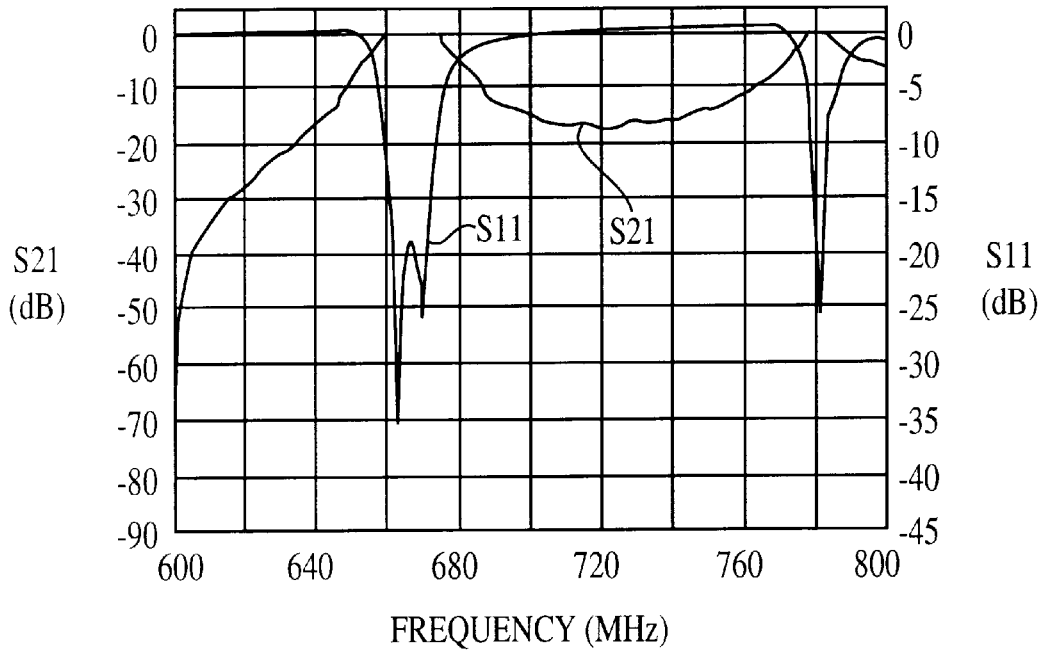
FIG. 18 is a graph showing the transmission and reflection characteristics of the dielectric filter shown in FIGS. 14 and 15.

Next, the preferred embodiments of the present invention are explained. A dielectric filter 37 in FIGS. 14 and 15 as the above-described eighth preferred embodiment was produced, and the elements S11 and S12 of the S matrix (scattering matrix) of microwave energy flowing in the direction of the arrows S11 and S12 shown in FIG. 3 were measured. The result is shown in FIG. 18. From the measurement result, the dielectric filter 37 was understood to function as a band pass filter allowing a signal of a fixed frequency to pass through.

Figure 19:
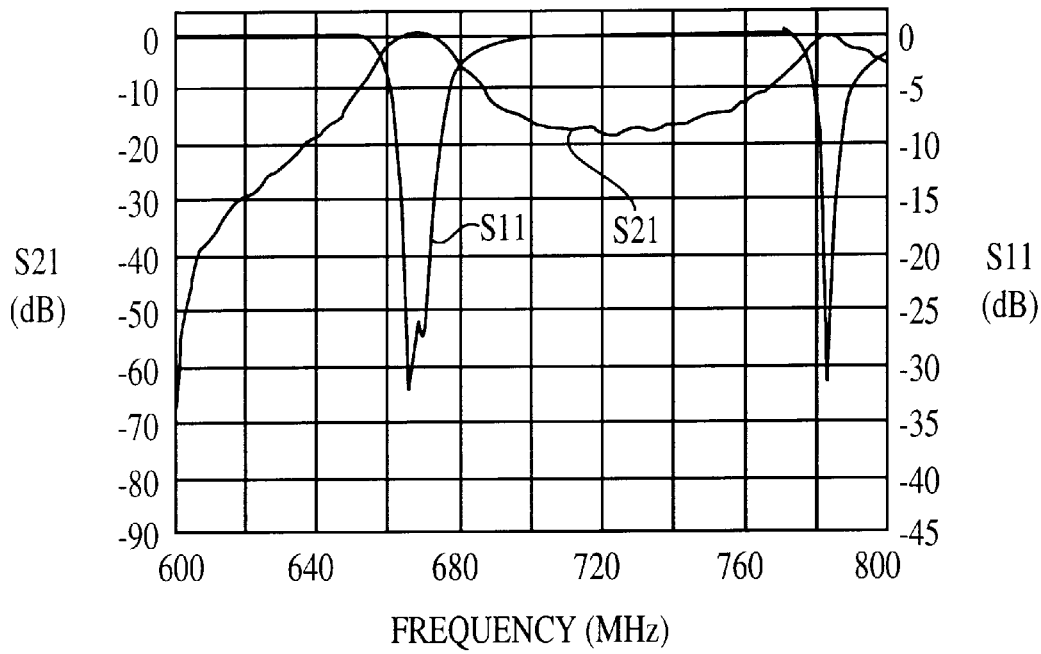
FIG. 19 is a graph showing the transmission and reflection characteristics of the dielectric filter shown in FIGS. 14 and 15, but with a conductor pattern the location of which is moved.
Figure 20:
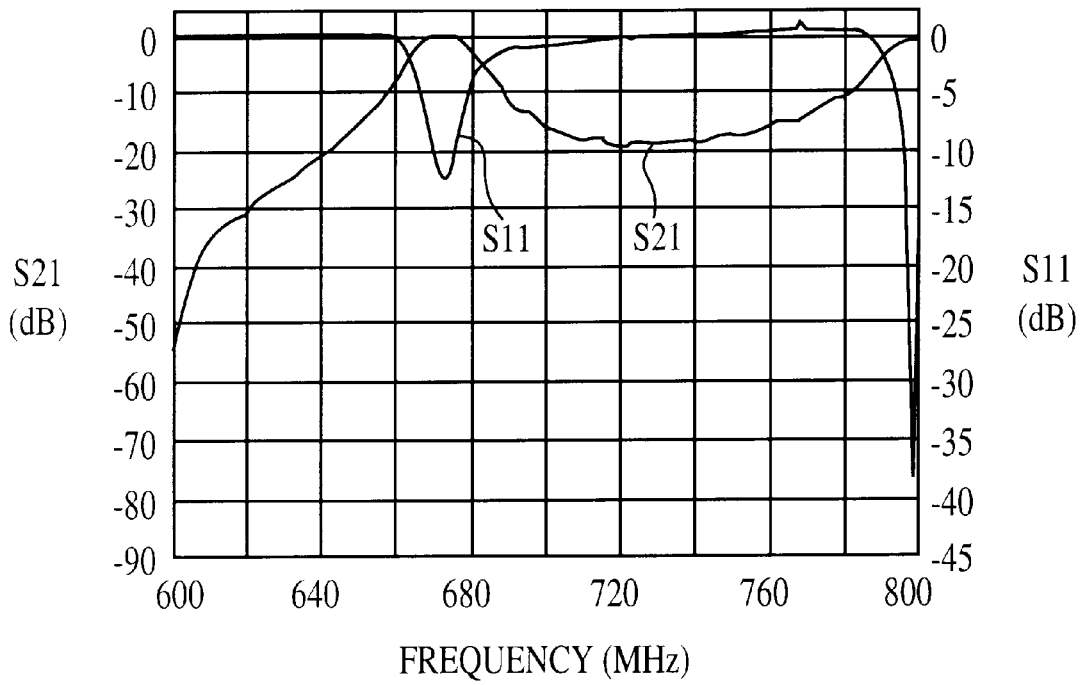
FIG. 20 is a graph showing the transmission and reflection characteristics of the dielectric filter shown in FIGS. 14 and 15, but with a conductor pattern the location of which is further changed.
Figure 21:
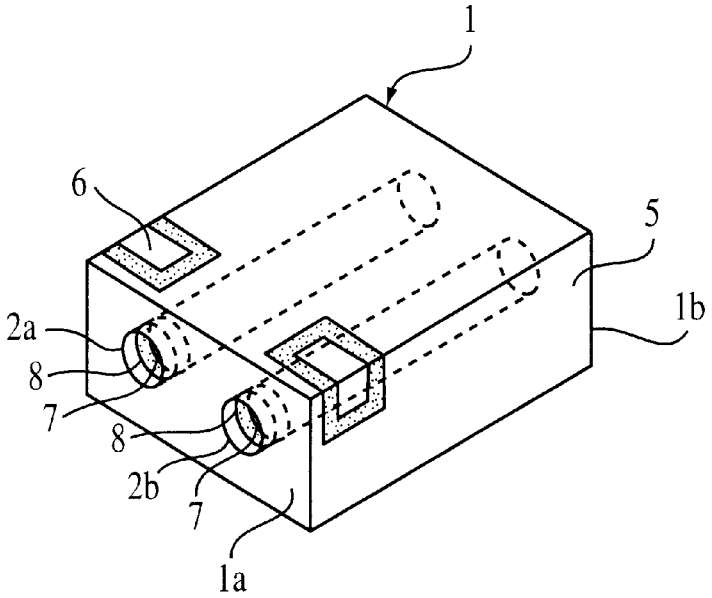
FIG. 21 PRIOR ART
FIG. 21 is a perspective view of a conventional dielectric filter.

Further, the dielectric filter 37 of the above-described eighth embodiment was modified, and a dielectric filter with a conductor pattern 23 provided at the location of P2 instead of the conductor pattern 23 provided at the location of P1 in FIG. 15 and a dielectric filter with conductor patterns 23 provided at the two locations of P3 and P4 instead of the conductor pattern 23 provided at the location of P1 in FIG. 15 were produced. Then, the elements S11 and S12 of their S matrices were measured. The result is shown in FIGS. 19 and 20. From the measurement result, either of the dielectric filters 37 was understood to function as a band pass filter allowing a signal of a fixed frequency to pass through.

As clearly seen from the above explanation, according to the dielectric filter of the present invention, by altering the inductance of the microinductance generating means, the coupling between dielectric resonators can be easily adjusted in a wide range without changing the configuration, dimensions, etc. of a dielectric block.

Further, because a microinductance generating means is provided in a position keeping substantially same distance from each of resonator holes adjacent to each other, the inductance of the microinductance generating means equally operates upon the dielectric resonators formed by using these resonator holes, and the degree of coupling between the dielectric resonators can be more effectively adjusted.

Furthermore, when a microinductance generating means is provided by a conductor pattern or a metal lead wire, by alteration of its thickness, configuration, and dimensions the coupling of adjacent dielectric resonators can be easily adjusted without changing the configuration and dimensions of a dielectric block.

More, because at least one of resonator holes adjacent to each other has a step portion inside, by adjustment of the location of the step portion the resonator length of dielectric resonators can be adjusted or the coupling of dielectric resonators can be fine adjusted.

Furthermore, an open circuit surface of dielectric resonators constitutes a second end surface of a dielectric block and on the open circuit surface a fine frequency adjustment pattern is extended from either of the inner conductor or the outer conductor. Then, the fine frequency adjustment pattern constitutes a coupling capacitor between neighboring dielectric resonators and an inner conductor and a part of the capacitor between each dielectric resonator and an outer conductor. Accordingly, by altering the configuration of the fine frequency adjustment pattern, it is possible to change the coupling capacitor between dielectric resonators adjacent to each other and the resonance frequency of dielectric resonators. As a result, the degree of coupling and the resonance frequency can be easily fine adjusted.

Further, an outer conductor is extended on a second end surface of a dielectric block and a gap is provided between the extended outer conductor and an inner conductor provided on the inner wall surface of the resonator holes. Thus, an open circuit surface of resonators can be provided inside the resonator holes.

Further, when the coupling between dielectric resonators of dielectric filters for a transmitter system and receiver system constituting a duplexer is made to be adjusted by a microinductance generating means, the coupling between dielectric resonators of the dielectric filter for the transmitter system and the dielectric filter for the receiver system can be easily adjusted in a wide range without altering the configuration, dimensions, etc. of a dielectric block.

Further, in a communication system relating to the present invention, when at least one of dielectric filters and duplexers having the above-mentioned characteristics is provided, the coupling between dielectric resonators can be easily adjusted in a wide range without altering the configuration, dimensions, etc. of a dielectric block.

While the invention has been particularly shown and described with reference to preferred embodiments thereof, it will be understood by those skilled man in the art that the forgoing and other changes in form and details may be made therein without departing from the spirit of the invention.

What is claimed is:

1. A dielectric filter, comprising:

a dielectric block having a first end surface and a second end surface opposite to said first end surface;

a plurality of resonator holes passing through said dielectric block from said first end surface to said second end surface of said dielectric block;

an inner conductor provided on a respective inner surface of each of said resonator holes so as to provide a corresponding resonator; and an outer conductor provided on an outside surface of said dielectric block;

wherein said first end surface of said dielectric block constitutes a short-circuit end surface for said resonators;

said short-circuit end surface includes an inside portion including respective ends of adjacent ones of said resonator holes and an outside portion provided around said inside portion;

said inside portion is electrically separated from said outside portion by a non-conducting portion substantially encircling said inside portion; and said inside portion is connected to said outside portion by a microinductance.

2. The dielectric filter according to claim 1, wherein said microinductance is provided in a position substantially equidistant from each of said adjacent ones of said resonator holes.

3. The dielectric filter according to claim 1, wherein said microinductance comprises a conductor pattern on said dielectric block.

4. The dielectric filter according to claim 1, wherein a metal lead wire constitutes said microinductance.

5. The dielectric filter according claim 1, wherein at least one of said adjacent ones of said resonator holes has a step portion therein.

6. The dielectric filter according to claim 1, wherein said second end surface of said dielectric block constitutes an open circuit surface for said resonators and a fine frequency adjustment pattern is provided extending onto said open circuit surface from one of said inner conductor and said outer conductor.

7. The dielectric filter according to claim 1, wherein said outer conductor is extended onto the second end surface of said dielectric block and into said resonator holes and a gap is provided between the extended outer conductor and each inner conductor and on the inner surface of each of said resonator holes.

8. A duplexer comprising:

a first filter and a second filter, said first filter being connected between a receiving circuit terminal and an antenna terminal, said second filter being connected between a transmitting circuit terminal and said antenna terminal;

wherein at least one of said first filter and said second filter is a dielectric filter which comprises:

a dielectric block having a first end surface and a second end surface opposite to said first end surface;

a plurality of resonator holes passing through said dielectric block from said first end surface to said second end surface of said dielectric block;

an inner conductor provided on a respective inner surface of each of said resonator holes so as to provide a corresponding resonator; and an outer conductor provided on an outside surface of said dielectric block;

wherein said first end surface of said dielectric block constitutes a short-circuit end surface for said resonators;

said short-circuit end surface includes an inside portion including respective ends of adjacent ones of said resonator holes and an outside portion provided around said inside portion;

said inside portion is separated from said outside portion by a non-conducting portion substantially encircling said inside portion; and said inside portion is connected to said outside portion by a microinductance.

9. A communication system comprising:

a receiving circuit and a transmitting circuit;

at least one of said receiving and transmitting circuits including a filter;

said filter being a dielectric filter which comprises:

a dielectric block having a first end surface and a second end surface opposite to said first end surface;

a plurality of resonator holes passing through said dielectric block from said first end surface to said second end surface of said dielectric block;

an inner conductor provided on a respective inner surface of each of said resonator holes so as to provide a corresponding resonator; and an outer conductor provided on an outside surface of said dielectric block;

wherein said first end surface of said dielectric block constitutes a short-circuit end surface for said resonators;

said short-circuit end surface includes an inside portion including respective ends of adjacent ones of said resonator holes and an outside portion provided around said inside portion;

said inside portion is separated from said outside portion by a non-conducting portion substantially encircling said inside portion; and said inside portion is connected to said outside portion by a microinductance.

10. A communication system comprising:

a receiving circuit and a transmitting circuit; and a duplexer, said duplexer comprising:

a first filter and a second filter, said first filter being connected between a receiving circuit terminal and an antenna terminal, said second filter being connected between a transmitting circuit terminal and said antenna terminal;

wherein at least one of said first filter and said second filter is a dielectric filter which comprises:

a dielectric block having a first end surface and a second end surface opposite to said first end surface;

a plurality of resonator holes passing through said dielectric block from said first end surface to said second end surface of said dielectric block;

an inner conductor provided on a respective inner surface of each of said resonator holes so as to provide a corresponding resonator: and an outer conductor provided on an outside surface of said dielectric block;

wherein said first end surface of said dielectric block constitutes a short-circuit end surface for said resonators;

said short-circuit end surface includes an inside portion including respective ends of adjacent ones of said resonator holes and an outside portion provided around said inside portion;

said inside portion is separated from said outside portion by a non-conducting portion substantially encircling said inside portion; and said inside portion is connected to said outside portion by a microinductance;

said receiving circuit being connected to said receiving circuit terminal of said duplexer; and said transmitting circuit being connected to said transmitting circuit terminal of said duplexer.

* * * * *